US007413176B2

(12) United States Patent
Hirata et al.

(10) Patent No.: US 7,413,176 B2
(45) Date of Patent: Aug. 19, 2008

(54) SHEET FINISHER

(75) Inventors: Tetsuo Hirata, Hachioji (JP); Motoki Nakamichi, Hachioji (JP); Norishige Kato, Hachioji (JP); Takehiro Ogushi, Hachioji (JP); Yasushi Saitsu, Hachioji (JP)

(73) Assignee: Konica Minolta Business Technologies Inc., Tokyo (JP)

( * ) Notice: Subject to any disclaimer, the term of this patent is extended or adjusted under 35 U.S.C. 154(b) by 322 days.

(21) Appl. No.: 11/134,577

(22) Filed: May 19, 2005

(65) Prior Publication Data

US 2006/0038336 A1 Feb. 23, 2006

(30) Foreign Application Priority Data

Aug. 20, 2004 (JP) ..... 2004-240538

(51) Int. Cl.
*B65H 37/04* (2006.01)

(52) U.S. Cl. ..... 270/58.08; 270/58.07; 270/58.09; 270/58.12; 270/58.13; 270/58.17

(58) Field of Classification Search ..... 270/37, 270/52.18, 58.07, 58.08, 58.09, 58.11, 58.12, 270/58.13, 58.17; 412/9, 18, 33, 36
See application file for complete search history.

(56) References Cited

U.S. PATENT DOCUMENTS

| | | | | |
|---|---|---|---|---|
| 4,586,640 | A * | 5/1986 | Smith | 227/14 |
| 5,569,012 | A * | 10/1996 | Kosasa et al. | 412/33 |
| 5,964,459 | A * | 10/1999 | Yamanaka | 270/58.08 |
| 6,351,625 | B1 * | 2/2002 | Sato et al. | 399/382 |
| 6,527,269 | B2 * | 3/2003 | Yamada et al. | 271/221 |

FOREIGN PATENT DOCUMENTS

| | | | |
|---|---|---|---|
| JP | 62285866 | A * | 12/1987 |
| JP | 7-89259 | A | 4/1995 |
| JP | 10-194586 | A | 7/1998 |

* cited by examiner

*Primary Examiner*—Gene O. Crawford
*Assistant Examiner*—Leslie A Nicholson, III
(74) *Attorney, Agent, or Firm*—Frishauf, Holtz, Goodman & Chick, P.C.

(57) ABSTRACT

A sheet finisher includes a sheet stacker for stacking sheets conveyed from an image forming apparatus to form a sheet bundle and a binding device for binding the sheet bundle with a staple, further includes a center folding device for center folding sheets conveyed from the image forming apparatus, a first conveying device for conveying sheets conveyed from the image forming apparatus to the sheet stacker without passing through the center folding device, and a second conveying device for conveying the sheets to the sheet stacker via the center folding device.

5 Claims, 8 Drawing Sheets

FIG. 4 ( a-1 )
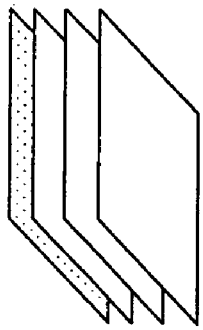
FIG. 4 ( b-1 )
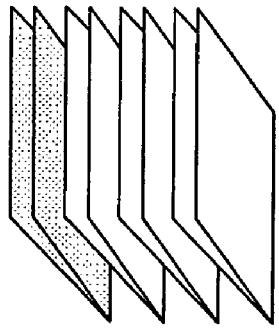
FIG. 4 ( a-2 )
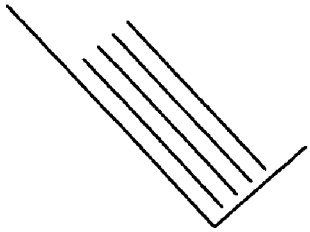
FIG. 4 ( b-2 )
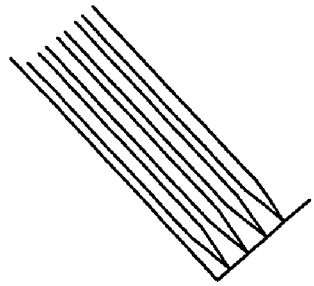

SHEET FINISHER

This application claims priority from Japanese Patent Application No. 2004-240538 filed on Aug. 20, 2004, which is incorporated hereinto by reference.

BACKGROUND OF THE INVENTION

The present invention relates to a sheet finisher which center folds and binds sheets that have been outputted from an image forming apparatus such as a copier, printer, or the like.

A sheet finisher makes a sheet bundle by using a stacking means to stack sheets on which images have been formed by an image forming apparatus, and binds the sheet bundle, thereby creating a book or a document. It is commonly used as a peripheral equipment connected to an image forming apparatus.

There are commonly used means for binding a sheet bundle, one is a means that uses an apparatus, called stapler, which uses staples to bind one edge of the sheet bundle, and another is a means that uses binding tape with hot-melt glue applied thereon and aligns and binds a prescribed side edge of the sheet bundle while heating the tape (for example, see patent document 1).

It is preferable that sheet bundles to be bound as stated above be the same size in terms of convenience of processing, and, for example, when A3-size sheets are to be bound, the sheets are first Z-folded and then the resulting A4-size sheets are bundled and bound (for example, see patent document 2).

However, in case of binding by using the above-mentioned binding tape, when a sheet bundle having Z-folded sheets only or a sheet bundle including Z-folded sheets is bound, binding is not ensured and sheets may fall out occasionally.

Furthermore, in order to make binding more secure, in some cases, a sheet bundle which has been bounded by staples, is further bound by binding tape.

In order to conduct such procedures, a sheet finisher is required to have a folding means for Z-folding or center-folding sheets, and a binding means for binding a sheet bundle by using staples or binding tape, so that users can properly select those means and conduct prescribed procedures. Accordingly, the apparatus is usually of considerable size or is connected to two or more pieces of other apparatus which includes the above-mentioned means.

Patent document 1 represents Published Unexamined Japanese Patent Application No. Tokkaihei 7-89259 (pages 1 and 2), and Patent document represents Published Unexamined Japanese Patent Application No. Tokkaihei 10-194586 (page 1).

SUMMARY OF THE INVENTION

In the light of the above-mentioned circumstances, an object of the present invention is to provide a small sized sheet finisher which includes a sheet stacking means that stacks sheets conveyed from an image forming apparatus or stacks the sheets which have been center folded, thereby forming a sheet bundle and then binds the sheet bundle by using staples or binding tape.

The above object is achieved by any one of Items (1) to (7) described below.

(1) A sheet finisher includes a sheet stacking means for stacking sheets conveyed from an image forming apparatus to form a sheet bundle and a binding means for binding the sheet bundle with a staple, further includes a center folding means for center folding sheets conveyed from the image forming apparatus, a first conveying means for conveying sheets conveyed from the image forming apparatus to the sheet stacking means without passing through the center folding means, and a second conveying means for conveying the sheets to the sheet stacking means via the center folding means.

(2) A sheet finisher according to item (1), wherein the second conveying means includes a stopper which the leading edges of the conveyed sheets hit, and which can be moved in the direction of the sheets being conveyed.

(3) A sheet finisher according to item (1), further includes a second binder for binding the sheet bundle with a binding tape, wherein the sheet conveyed from the image forming apparatus passing through the center-folding device at which the sheet has been center folded, conveyed by the second conveyance device, and the sheet conveyed from the image forming apparatus and conveyed by the first conveyance device, are stacked on the sheet stacker and bound together by at least one of the binder with the staple and the second binder with the binding tape.

(4) A sheet finisher which stacks sheets conveyed from an image forming apparatus to form a sheet bundle and binds the sheet bundle, includes a first binding means for binding the sheet bundle by using staples, a second binding means for binding the sheet bundle by using binding tape, and a sheet stacking means used for both the first binding means and the second binding means.

(5) A sheet finisher according to item (4), wherein the second binding means binds a sheet bundle that has been bound by the first binding means.

(6) A sheet finisher includes a first sheet stacking means for stacking sheets conveyed from an image forming apparatus to form a sheet bundle, a first binding means for binding the sheet bundle using staples that has been stacked on the first sheet stacking means, a second sheet stacking means for successively stacking the sheet bundles that have been bound by the first binding means, and a second binding means for binding the sheet bundle using binding tape that has been stacked on the second sheet stacking means.

(7) A sheet finisher according to item (6), wherein the first binding means moves each binding position of the sheet bundles and binds them so that each sheet bundle is bound at a different position.

BRIEF DESCRIPTION OF THE DRAWINGS

FIGS. 4(*a*-1) to 4(*b*-2) show examples of sheet bundles;

DETAILED DESCRIPTION OF THE PREFERRED EMBODIMENT

Hereafter, an embodiment of the present invention will be explained with reference to the drawings.

Figure 1:
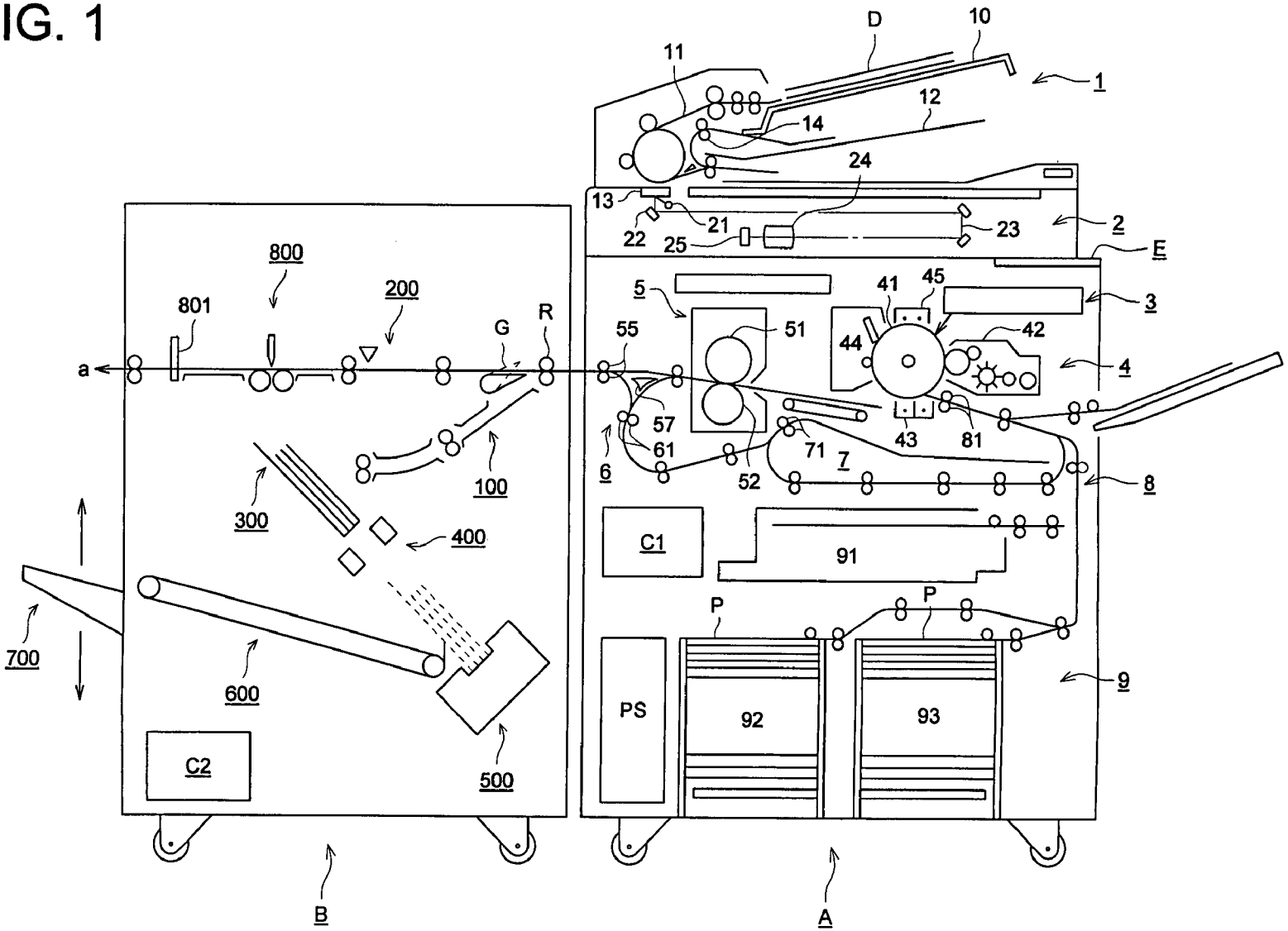
FIG. 1 is a conceptual diagram of an image forming apparatus which connects to a sheet finisher.

FIG. 1 is a conceptual diagram of an image forming apparatus which is connected to a sheet finisher.

Image forming apparatus A is a digital copier which forms images by means of known electrophotographic technology. The image forming apparatus A includes an automatic document feeder 1 at an upper part thereof, and is connected to sheet finisher B.

The image forming apparatus A is constituted by an automatic document feeder 1, a reading means 2, a writing means 3, an image forming means 4, a fixing means 5, a reversing and ejecting means 6, a re-feeding means 7, a sheet conveying means 8, a sheet feeding means 9, controller C1, and operation and display means E.

The automatic document feeder 1 feeds documents D one by one which are stacked on the document stack table 10 to the document conveying path 11 and ejects the documents onto the document eject table 12. While a document D is being conveyed, the image side of the document is read by the reading means 2 at a document reading position 13. When images on both sides of the document D are to be read, the document D will be inverted by an inverting means 14 after an image on one side has been read, and fed on the document conveying path 11 again, and then an image on the other side will be read, and finally the document will be ejected onto the document eject table 12.

The reading means 2, which is constituted by a light source 21, a first mirror unit 22, a second mirror unit 23, an imaging lens 24, and a CCD 25, scans the image of the document D at the image reading position 13 while it is traveling, and forms the image by means of the CCD 25, and converts optical document image information into electrical information. The converted document image information is processed with A/D conversion, shading correction, and compression, and then stored in memory M1 of controller C1.

The writing means 3 is an optical scanning system which is constituted by a laser light source, a cylindrical lens, a Fθ lens, a mirror, and a polygon mirror. The writing means 3 scans the surface of the photoconductor 41 of the image forming means 4 by means of a laser beam that changes in response to image information read from the memory M, and forms a latent image on the surface of the photoconductor 41.

The image forming means 4 develops the latent image that has been formed on the surface of the photoconductor 41 by means of a development means 42 to convert the latent image into a visible toner image. The toner image is transferred onto a sheet P that has been fed to the transfer means 43 by the registration roller 81. After the toner image has been transferred from the photoconductor surface, remaining toner is removed from the surface by a cleaning means 44, and the charging means 45 charges electricity onto the surface so as to be ready for forming the subsequent latent image.

The fixing means 5 heats and pressurizes the sheet P that is carrying a toner image by means of the heat roller 51 and the pressure roller 52 which is provided opposite to the heat roller 51 so as to fix the toner image on the sheet P.

After the image has been fixed on the sheet P, the sheet P is ejected to the sheet finisher B by the eject roller 55.

When the sheet P is to be inverted and ejected, the sheet P is guided downward by the eject guide 57, and the trailing edge of the sheet P is supported by the inverting roller 61 of the inverting means, and then the sheet P is inverted and fed onto the eject roller 55.

When images are to be formed on both sides of the sheet P, the sheet P is fed to the re-feeding means 7 by the eject guide 57 and a plurality of rollers, inverted by the inverting roller 71 of the re-feeding means 7, and then re-fed to the sheet conveying means 8.

The sheet conveying means 8, which has a plurality of rollers and a guide member, is a sheet conveying path. The sheet conveying means 8 conveys sheet P fed by the sheet feeding means 9, hits the leading edge of the sheet P with the registration roller 81, and then conveys the sheet P to the photoconductor 41 so as to receive a toner image.

The sheet feeding means 9 is constituted by a first sheet feeding means 91 including a small-capacity tray, a second sheet feeding means 92 including a large-capacity tray, and a third sheet feeding means 93. Each of the sheet feeding means includes a feeding roller 916, 926 or 936 for feeding individual sheets P stacked on each tray to the sheet conveying means 8. Furthermore, each of the second sheet feeding means 92 and the third sheet feeding means 93 has an upper face detection means for detecting the upper face of the stacked sheets. Based on the upper face detection signal sent by the detection means, controller C1 lifts and lowers the bottom side of the tray on which sheets P are stacked.

Operation and display means E is a touch panel provided on the upper surface of the image forming apparatus A body. Operation and display means E has both display and input functions, and is used to conduct instructions to controller C1, such as an instruction for setting the number of sheets copied, or setting whether to apply the finishing process to the outputted reproduced sheet.

As shown in the drawing, the sheet finisher B is constituted by a first conveying means 100, a second conveying means 200, a sheet stacking means 300, a first binding means 400, a second binding means 500, a third conveying means 600, a sheet ejection tray 700, conveying path switching means G, and controller C2.

Figure 2:
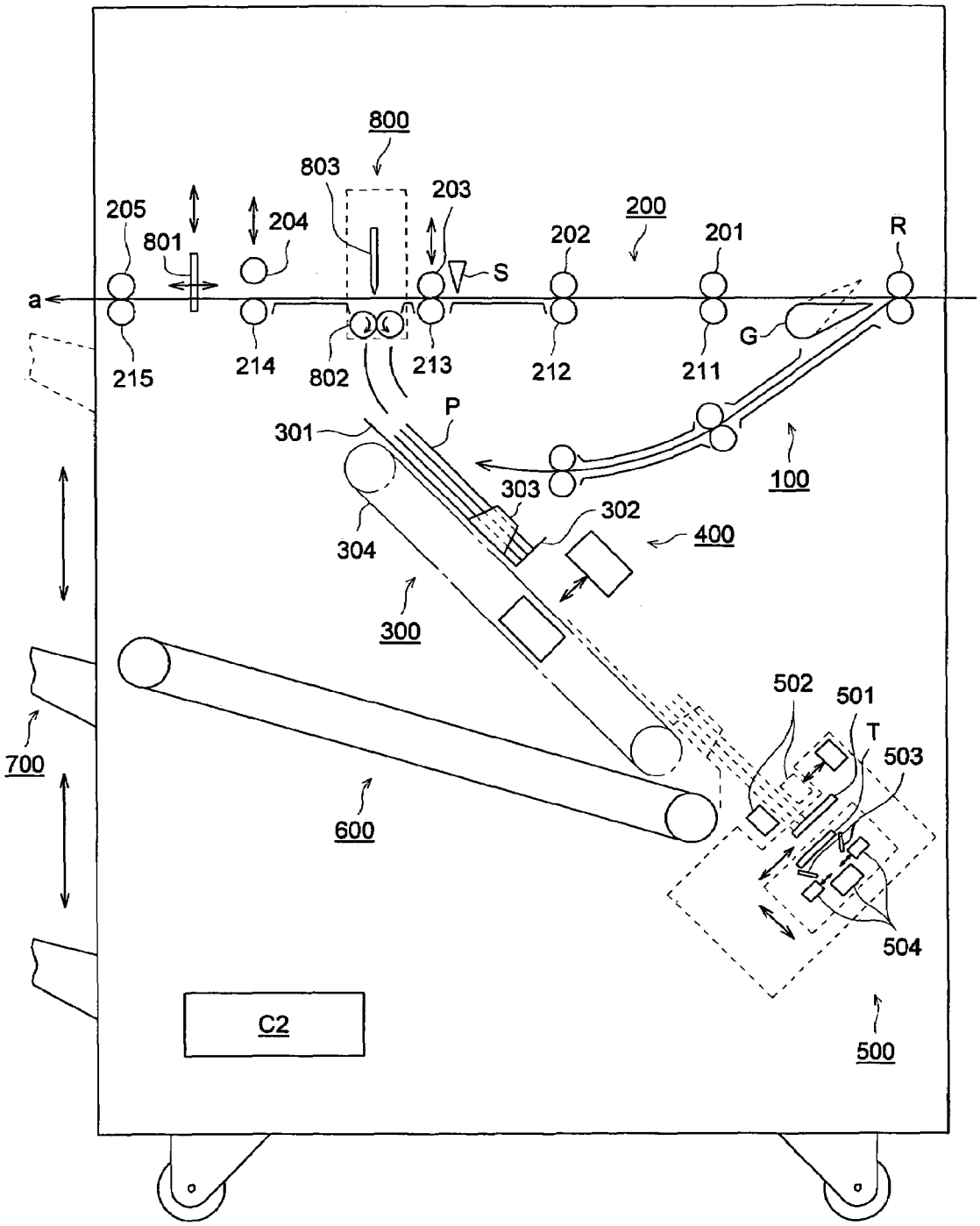
FIG. 2 is a conceptual diagram of a sheet finisher.

FIG. 2 is a conceptual diagram which explains in detail the sheet finisher shown in FIG. 1.

The first conveying means 100 is constituted by a plurality of conveying rollers and a plurality of guide plates. Sheet P ejected by an image forming apparatus A is guided to the first conveying means 100 by carry-in roller R of the sheet finisher B and conveying path switching means G located at the position indicated by a dotted line in the drawing, and then the sheet P is placed on the sheet stacking means 300 by the first conveying means 100.

The second conveying means 200 is also constituted by a plurality of conveying rollers and a plurality of guide plates. Sheet P ejected by image forming apparatus A is guided to the second conveying means 200 by the carry-in roller R of sheet finisher B and the conveying path switching means G located at the position indicated by a solid line. When an operation mode has been selected by means of operation and display means E so as not to conduct the center folding procedure, the second conveying means 200 conveys the sheet P in the direction of arrow 'a' and places the sheet P onto the sheet ejection tray 700.

When an operation mode has been selected so as to conduct the center folding procedure, the leading edge of the sheet P hits the stopper 801 and is stopped, and the sheet P is center folded by the center folding means 800, and then guided downward by the rollers and guide plates, and placed on the sheet stacking means 300.

The sheet stacking means 300 is constituted by a stacker 301 which successively stacks sheets P conveyed by a first conveying means 100 or second conveying means 200, a leading edge aligning plate 302 which aligns the leading edges of sheets P stacked on the stacker 301, a side edge guide 303 which aligns the sides of sheets P, and a stacker moving means 304.

Sheets P successively stacked on the stacker 301 slide down and drops from the stacker 301, and the leading edges of sheets P hit the leading edge aligning plate 302 thereby aligning the leading edges, which is located at the edge of the stacker 301, and the side edges of sheets P are aligned by the sliding side edge guide 303, thereby creating a sheet bundle with aligned edges.

The stacker 301 is moved by the stacker moving means 304 from the position indicated by the solid line to the position indicated by the dotted line in the drawing. The leading edge aligning plate 302 located at the front of the stacker 301 can rotate and move, and when it is located at the position indicated by the dotted line in the drawing, it moves downward. Moreover, the stacker moving means 304 is constituted by a driving pulley, a driven pulley, and a belt which is entrained about those pulleys. The oblong circle shown by the dashed-dotted line in the drawing indicates the locus of the belt rotation. The belt is connected to the edge of the stacker 301, and controller C2 can control the stacker 301 to stop at a prescribed position so that the first binding means 400 and the second binding means can conduct the binding procedure.

The first binding means 400 is a means for binding the edge of the sheet bundle by using staples at any location, and this is a means, generally called a stapler, that uses known technology. A stapler according to this embodiment can move the binding position by means of controller C2 in the back and forth direction in the drawing. The stacker 301 which stacks the sheet bundle moves downward by the stacker moving means 304 and stops at a prescribed position, and the first binding means 400 binds the stacked sheet bundle.

The second binding means 500 is a means for binding the edge of the sheet bundle by using binding tape T on which hot-melt glue has been applied, and this is a known means commonly used for binding apparatus.

The sheet bundle located on the stacker 301 that has stopped very near the binding means 500 slides down on the stacker 301 as the leading edge aligning plate 302 moves downward, and the leading edge of the sheet bundle hits the leading edge stop plate 501 thereby aligning the leading edges of all the sheets, and also side edges are aligned by the sliding operation of the side edge guide 303.

The sheet bundle whose edges have been aligned is supported by a sheet bundle holding means 502. When the edge of the sheet bundle is supported by the sheet bundle holding means 502, the leading edge stop plate 501 moves downward, and the glued surface of the binding tape T which has been cut into a prescribed length tightly seals and binds the edge surface of the sheet bundle, and then the tape conveying means (not shown) moves away.

Both sides of the binding tape T are folded toward the upper face and the bottom face of the sheet bundle by means of two folding members 503 that move forward from the back surface of the binding tape T toward the sheet bundle. The folded binding tape T is contact pressed onto the back surface and two side surfaces of the sheet bundle while being heated by the heating means 504 that has moved to the position.

When the heating means 504 has finished heating and contact pressing the sheet bundle for the prescribed period of time, it returns to its original position, and the glue of the binding tape T cools thereby binding the sheet bundle by the binding tape T.

After binding by the binding means 500 has finished, the stacker 301 moves upward, and unbound other edges of the sheet bundle are placed on the third conveying means 600 which is a belt-type conveying means. Next, the sheet holding means 502 releases the sheet bundle thereby stacking the sheet bundle on the third conveying means 600, and then the sheet bundle is ejected onto the sheet ejection tray 700.

The sheet ejection tray 700 can be lifted and lowered, and uses known technology. The upper face of the tray or the upper-most face of the tray when sheets or a sheet bundle has already been stacked on the tray is controlled by controller C2 so that the tray surface is located at a position at which the sheets or the sheet bundle ejected by the first through the third conveying means are successively stacked.

The center folding means 800 is a means for folding sheet P along a center line, and is located on the conveying path of the second conveying means 200. This means also uses known technology.

In the present invention, the center line of sheet P is accurately stopped in the position at which the blade of the folding knife 803 is located directly above so as to prevent the edge of the sheet bundle from misaligning due to the dislocation of the sheet P folding position from the center line of sheet P.

The leading edge of sheet P that has been conveyed by a plurality of rollers of the second conveying means 200 is detected by a sheet detection sensor S located on the conveying path. When the detection signal is sent by the sheet detection sensor S to the controller C2, based on sheet P size information sent by the controller C1 of the image forming apparatus A, the controller C2 first moves the stopper 801 along the conveying path so that the center line of the sheet P accurately stops at the edge of the blade of the folding knife 803, and then lowers the stopper 801 to block the conveying path so that the leading edge of the approaching sheet P hits.

On the other hand, after the leading edge of the sheet P has been detected by the sheet detection sensor S, conveying rollers 203 and 213 are controlled by the controller C2 so that the leading edge of the sheet P is fed slightly forward (for example, several millimeters) of the position at which the leading edge hits the stopper 801. Therefore, a slight bending occurs on the sheet P which has been fed slightly to the rollers 202 and 213 when the leading edge of sheet P hits the stopper 801. The conveying roller 203 moves upward after conveying a prescribed amount of sheet P. Accordingly, the trailing edge of sheet P in which the leading edge thereof hits the stopper 801 moves in the reverse direction of the conveying direction, thereby eliminating the bending and making sheet P flat.

Thus, the sheet P comes to rest laying completely flat in a position in which its center line is right below the blade of the folding knife 803. The stopped sheet P is folded at the center line by the descending folding knife 803, and pushed into the rotating folding rollers 802. The pressed sheet P is folded in half, and then placed on the stacker 301 of the sheet stacking means 300 with the folded edge facing to the front forward.

Figure 3:
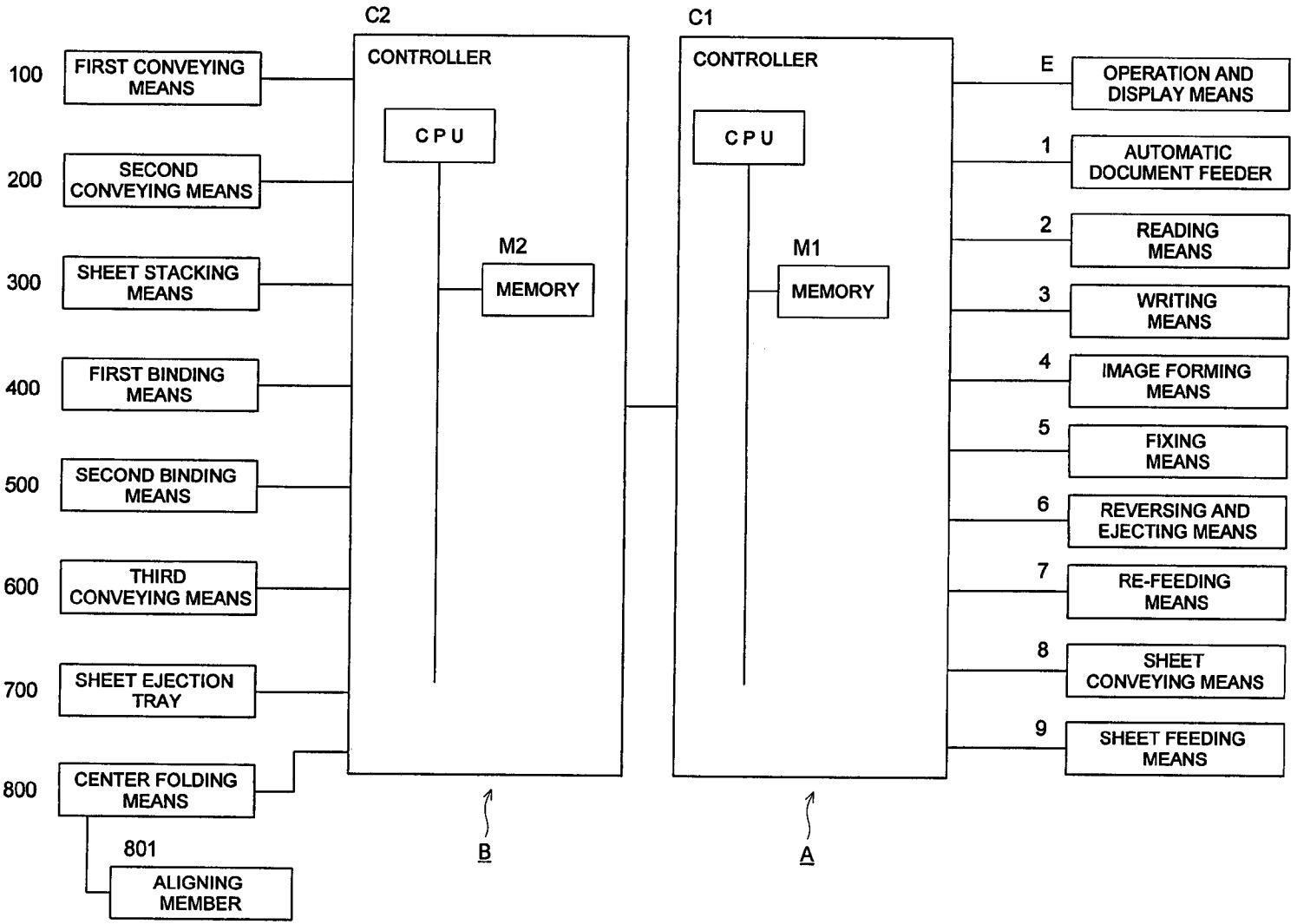
FIG. 3 is a block diagram which shows a control relationship between a sheet finisher and an image forming apparatus.

FIG. 3 is a block diagram which shows a control relationship between sheet finisher B and image forming apparatus A according to this embodiment.

Controller C2 of the sheet finisher B and controller C1 of the image forming apparatus individually is constituted by a CPU, an arithmetic unit, memory, an input/output I/F, a communication means, a drive circuit, and programs that have been stored in the memory. In this drawing, blocks which are not necessary for explaining this embodiment are not shown.

FIGS. 4(*a*-1) and 4(*b*-2) show examples of sheet bundles which are formed on the stacker of the sheet finisher B.

FIGS. 4(*a*-1) and 4(*a*-2) schematically show the sheet bundle formed by stacking sheets P that have been conveyed by the first conveying means 100, and FIGS. 4(*b*-1) and 4(*b*-2) schematically show the sheet bundle formed by stacking sheets P that have been center folded by the center folding means 800 and conveyed by the second conveying means 200.

Figure 5:
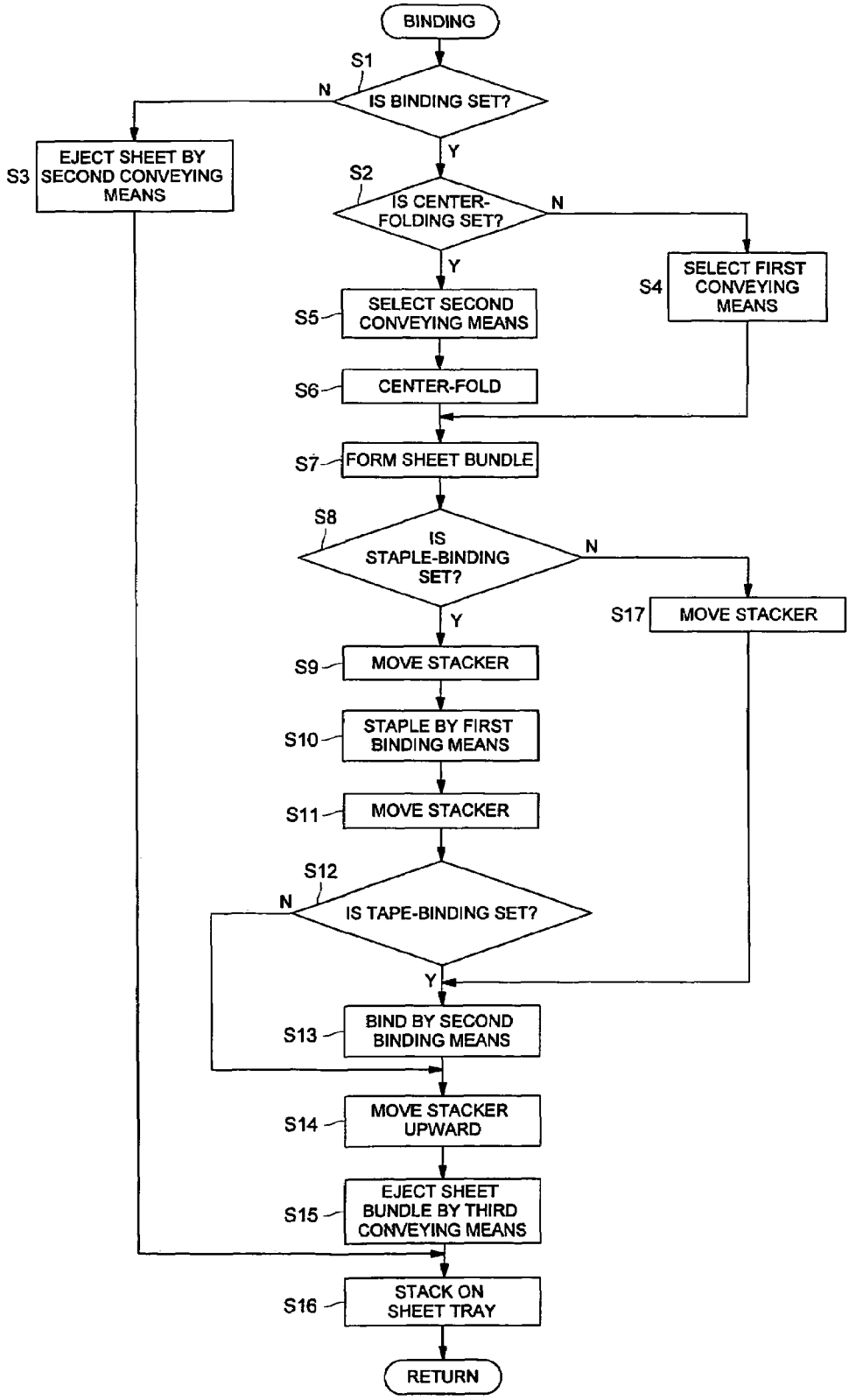
FIG. 5 is a flow chart which shows the flow of center folding and binding procedures.

FIG. 5 is a flow chart which shows the flow of center folding and binding procedures conducted by the above-mentioned sheet finisher B.

Users set procedures to be conducted in the sheet finisher B by using the operation and display means E of the image forming apparatus A. The set information is sent from the controller C1 to the controller C2 of the sheet finisher B. Based on the sent information, a judgment is made whether the setting has been made to conduct the binding process (step S1). If the setting for conducting the binding process has not been made (step S1: N), sheets P are sent to the second conveying means 200 and ejected by the second conveying means onto the sheet ejection tray 700 (steps S3, S16).

If the setting for conducting the binding process has been made (step S1: Y), a judgment is made whether the setting has been made to center fold sheets P (step S2). If the setting for conducting the center folding process has not been made (step S2: N), sheets P are sent to the first conveying means 100, and stacked on the stacker 301 of the sheet stacking means 300 thereby forming a sheet bundle (step S4, S7). If the setting for conducting the center folding process has been made (step S2: Y), sheets P are sent to the second conveying means 200, stopped at a prescribed position, as described above, and are center folded by the center folding means 800 (step S6), and then stacked on the stacker 301, thereby forming a sheet bundle (step S7).

If the setting for conducting the staple-binding process has been made (step S8: Y), the stacker 301 that stacks the sheet bundle moves to the position at which binding is conducted by the first binding means 400 and stops (step S9). After the binding process conducted by the first binding means 400 has been finished (step S10), the stacker moves close to the second binding means 500. At this point, the leading edge aligning plate 302 located at the front of the stacker 301 moves downward, and accordingly, the sheet bundle slides down on the stacker 301, and the leading edge of the sheet bundle hits the leading edge stop plate 501 of the second binding means 500 and is stopped (step S11).

If the setting for conducting the tape-binding process has been made (step S12: Y), tape-binding is conducted by the second binding means 500 after the leading edge of the sheet bundle has been supported by the sheet holding means 502 (step S13).

After the binding process has been finished, the stacker 301 moves upward to receive new sheets P (step S14), and the bound sheet bundle is stacked and conveyed by the third conveying means. 600 (step S15), and then ejected onto the sheet ejection tray 700 (step S16).

If the setting for staple-binding has been made and the setting for tape-binding has not been made (step S12: N), the sheet bundle bound by the first binding means 400 is stacked and conveyed by the third conveying means 600 (step S15), and then ejected onto the sheet ejection tray 700 (step S16).

If the setting for staple-binding has not been made and the setting for tape-binding has been made for the sheet bundle stacked on the stacker 301 (step S8), the stacker 301 moves close to the second binding means 500 (step S17), and binds the sheet bundle by means of the second binding means 500 as described above (step S13), and then the sheet bundle is ejected onto the sheet ejection tray 700 (steps S14 through 16).

Figure 6:
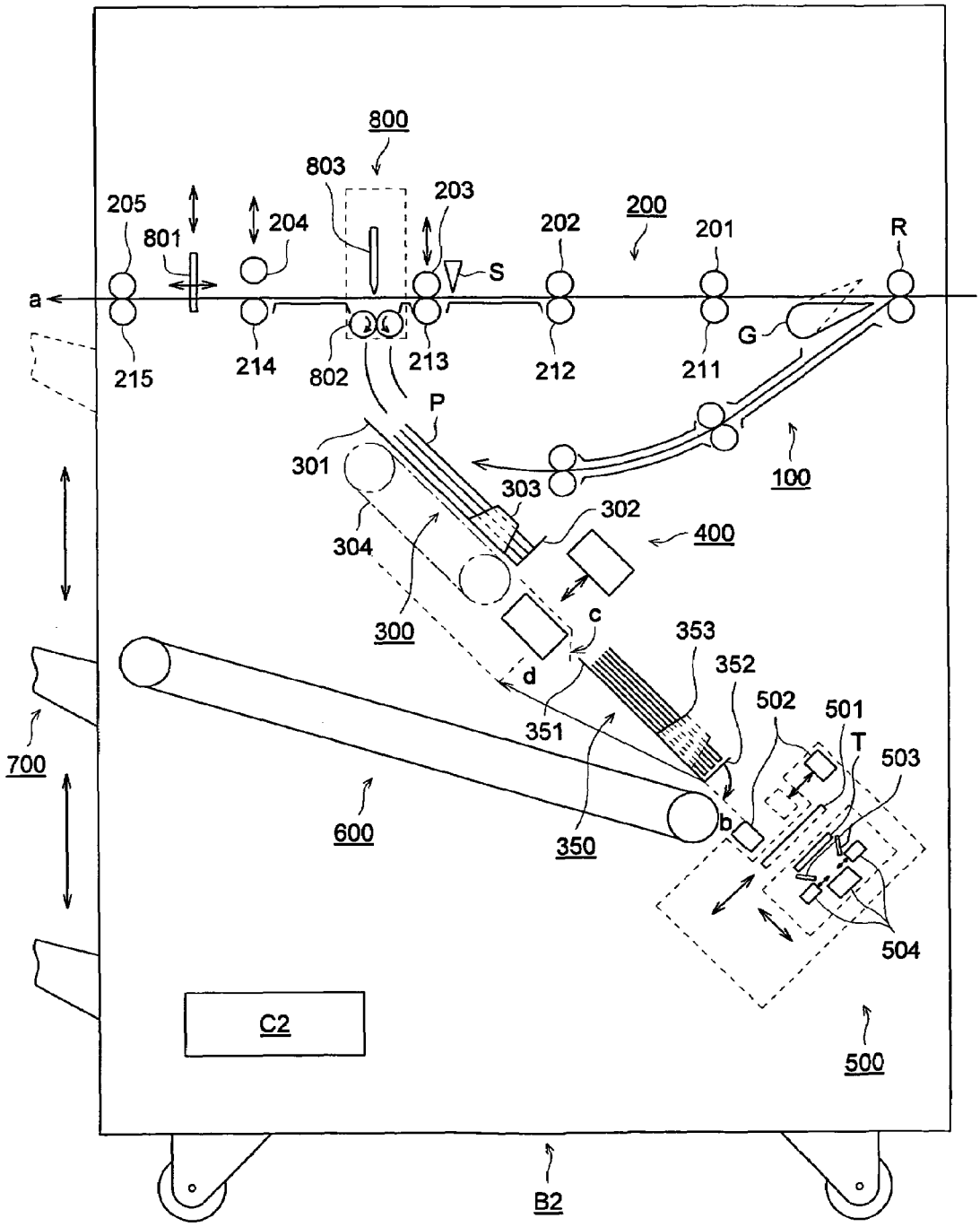
FIG. 6 is a conceptual diagram of a second sheet finisher.

FIG. 6 is a conceptual diagram which shows the second sheet finisher B2 that is provided with another sheet stacking means 350 (second sheet stacking means) in addition to the sheet stacking means 300 (first sheet stacking means) of the sheet finisher B shown in FIG. 2.

The sheet finisher B2 includes a second sheet stacking means 350 for successively stacking the sheet bundles bound by the first binding means 400 so that the second binding means will bind the stacked sheet bundles after a preset number of bound sheet bundles have been stacked.

Such procedures are effective when conducting book binding. For example, when making a book that includes a plurality of chapters each of which has a plurality of pages, first the pages of each chapter are individually bound by staples, and then the chapters can be bound together by binding tape, thereby making it possible to conduct accurate book binding.

In these procedures, the first binding means 400 is controlled by the controller C2 so that positions of staples are different for each sheet bundle. By controlling the process in this way, it is possible to have a uniform height on each surface of the sheet bundles stacked on the second sheet stacking means, thereby achieving neat book binding. Moreover, known technology is used for moving the binding position.

Figure 8:
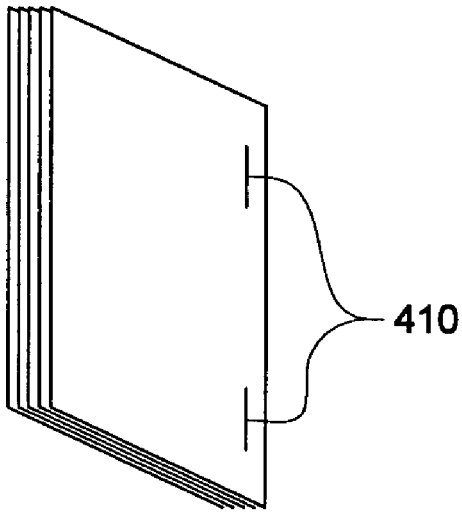
FIGS. 8(*a*) and 8(*b*) show examples of sheet bundles in which staples are provided at different positions.
Figure 8:
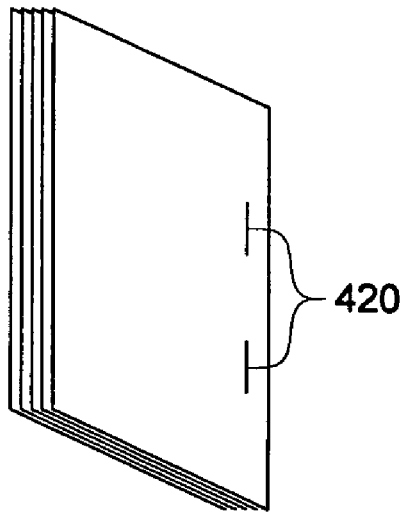

FIGS. 8(*a*) and 8(*b*) show examples of sheet bundles in which staples are provided at different positions.

In this example, the binding position of the staple 420 shown in FIG. 8(*b*) is further inside when compared to the binding position of the staple 410 shown in FIG. 8(*a*). The distance and direction the binding position has been moved have been preset by the controller C2.

Figure 7:
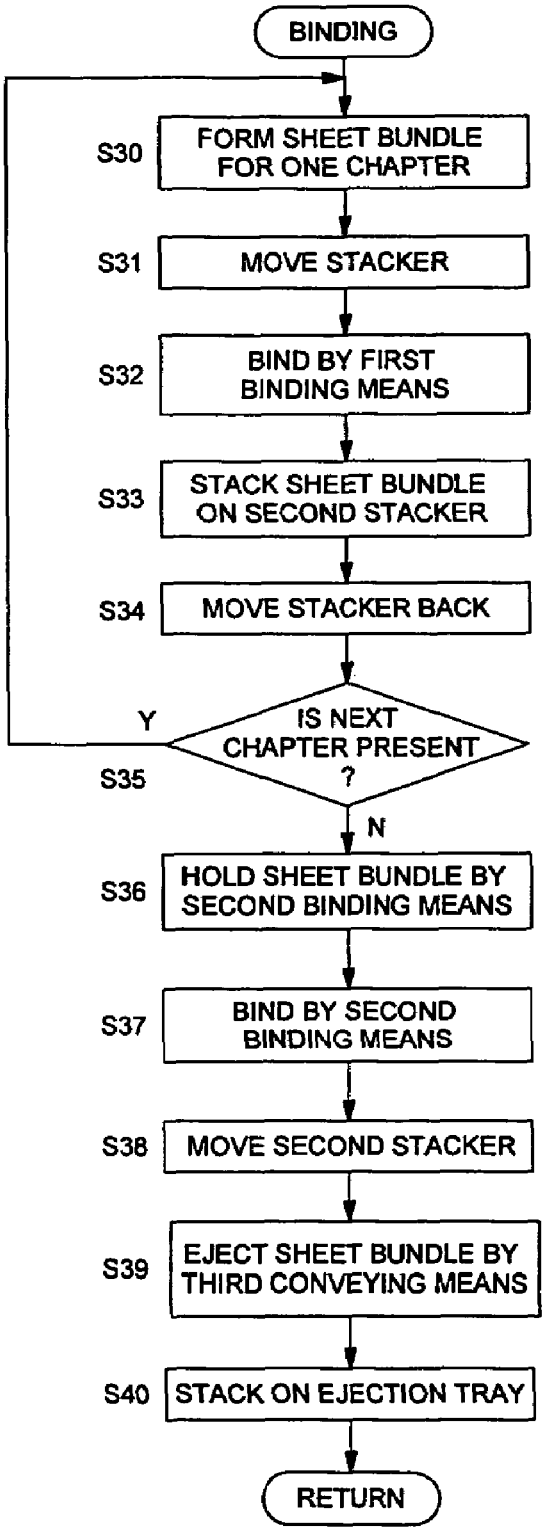
FIG. 7 is a flow chart which shows the flow of the binding procedure conducted by a second sheet finisher.

FIG. 7 is a flow chart which shows the flow of binding procedures conducted by the sheet finisher B2.

When a sheet bundle having one chapter is stacked on the stacker 301 of the first sheet stacking means 300 (step S30), the sheet bundle is bound by the first binding means according to the procedures explained in the flow chart shown in FIG. 6 (steps S31, S32).

The bound sheet bundle slides downward due to the movement (arrow 'c') of the leading edge stop plate 302, and stacked on the second stacker 351 of the second sheet stacking means 350 (step S33) The stacker 301 moves to the position at which it will receive the subsequent sheets P (step S34).

Such operations (steps S30 through S34) are repeated for each chapter (step S35: Y).

When a sheet bundle in which all of the chapters had been bound by the first binding means has been stacked on the second stacker 351 of the second sheet stacking means 350. (step S35: N), due to the movement (arrow 'b') of the second leading edge stop plate 352, the leading edges of a plurality of sheet bundles are aligned by the leading edge stop plate 501 of the second binding means 500, and then sides are also aligned by the sliding second side edge guide 353 of the second sheet stacking means 350. The leading edges of the plurality of aligned sheet bundles are held by the sheet holding means 502 (step S36).

The sheet bundle being held is bound by the second binding means 500 according to the procedures explained in the flow chart shown in FIG. 7 (step S37), stacked on the third conveying means 600 as the result of the movement (indicated by the arrow 'd') of the second stacker 351 (step S38), and then ejected onto the sheet ejection tray 700 (steps S39, S40).

As stated above, the present invention provides a small sized sheet finisher that can conduct the center folding operation and two types of binding operations, as shown as sheet finisher B and sheet finisher B2.

According to aforementioned Items (1) and (3), a sheet bundle including only center folded sheets, a sheet bundle having sheets only that have not been center folded, or a sheet bundle including center folded sheets and the sheets that have not been center folded are formed on one sheet stacking means. This makes it possible to reduce the size of the apparatus.

Further, advantages which are produced by stacking center-folded sheets and non-center-folded sheets on the stacking means are as follows.

1. When a sheet is center-folded, a thickness of the center-folded sheet is double a thickness of the sheet before center-folded, and an area of the center-folded sheet that is brought into contact with a binding tape is increased accordingly, and fewer sheets fall out.

2. Since the center-folded sheet is composed of four pages, when the number of total pages is not a multiple of four exactly, blank pages are caused. In that case, images are formed on non-center-folded sheets in quantity equivalent to a difference between the total pages and the multiple of four closest to the total pages, without center-folding all sheets. In this way, the number of blank pages is less, waste is avoided and a bundle of sheets is made look more attractive.

3. By inserting a color sheet in a place of the end of each chapter, it is impossible to divide chapters.

According to Item (2), the sheet folding position in the center folding procedure is accurate, and an accurately aligned sheet bundle is formed on the sheet stacking means. As a result, it is not necessary to cut the sheets to align the edges.

According to Item (4), the sheet stacking means for forming a sheet bundle is commonly used by both the first binding means for conducting the staple binding process and the second binding means for conducting the tape binding process, thereby making it possible to reduce the size and cost of the apparatus.

Further, in case of binding by using the binding tape, when a sheet bundle having center folded sheets only or a sheet bundle including center folded sheets is bound, binding can be made more secure and fewer sheets fall out.

According to Item (5), the binding by binding tape can be conducted immediately after the sheet bundle formed on the sheet stacking means has been bound by using staples. Therefore, the sheet bundle conveying path becomes the shortest, thereby preventing malfunctions from occurring during the conveyance of the sheet bundle and achieving a neatly and accurately bound sheet bundle.

According to item (6), the sheet bundle stacked on the first sheet stacking means is bound by staples by means of the first binding means, and the second sheet stacking means successively stacks such sheet bundles, and then a plurality of the sheet bundles stacked on the second sheet stacking means are bound by binding tape, thereby achieving a strong binding.

According to Item (7), because staple binding positions of a plurality of the staple-bound sheet bundles are different, it is possible to prevent the height of the stacked sheet bundles from becoming uneven, thereby achieving a neat binding.

What is claimed is:

1. A sheet finisher for stacking sheets conveyed from an image forming apparatus, to form a sheet bundle, and for binding the sheet bundle, the sheet finisher comprising:

a sheet stacker for stacking the sheets conveyed from the image forming apparatus to form the sheet bundle;

a first binder for binding the sheet bundle stacked on the sheet stacker with a staple;

a second binder for binding the sheet bundle stacked on the sheet stacker with a binding tape;

a stacker moving device for moving the sheet stacker to a position at which the first binder performs binding and to a position at which the second binder performs binding;

a center-folding device for folding a center of a sheet conveyed from the image forming apparatus;

a first conveyance device for conveying a sheet conveyed from the image forming apparatus to the sheet stacker without passing through the center-folding device; and a second conveyance device for conveying a sheet conveyed from the image forming apparatus to the sheet stacker through the center-folding device.

2. The sheet finisher of claim 1, wherein the sheet finisher is operable to bind the sheet bundle by the first binder and then to further bind the sheet bundle by the second binder.

3. The sheet finisher of claim 1, wherein the second conveyance device comprises a stopper which is movable into a conveyance path of the sheet conveyed by the second conveyance device such that a leading edge of the sheet hits the stopper to align the sheet.

4. A sheet finisher comprising:

a first sheet stacker for stacking sheets conveyed from an image forming apparatus to form a sheet bundle;

a first binder for binding the sheet bundle stacked on the first sheet stacker with a staple;

a second sheet stacker for sequentially stacking sheet bundles which have been bound by the first binder; and a second binder for binding the sheet bundles stacked on the second sheet stacker with a binding tape;

wherein the first sheet stacker comprises a leading edge stopper that aligns leading edges of the sheets stacked thereon; and wherein the leading edge stopper is movable to allow the sheet bundle which has been bound by the first binder to slide down from the first sheet stacker to be stacked on the second sheet stacker.

5. The sheet finisher of claim 4, wherein the first binder moves a binding position of the sheet bundle so that the binding position for each sheet bundle is different.

* * * * *